US006996958B1

(12) United States Patent
Yeh et al.

(10) Patent No.: US 6,996,958 B1
(45) **Date of Patent: *Feb. 14, 2006**

(54) WRAPPING MACHINE FOR PAPER AND PLASTIC PACKING

(76) Inventors: Chi-Yee Yeh, 7F, No. 49, Lane 331, Dexing E. Rd., Shilin Dist., Taipei (TW); Christine Huang, 8F, No. 153, Alley 95, Lane 113, Donghu Rd., Neihu Dist., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/937,298

(22) Filed: Sep. 10, 2004

(51) Int. Cl.
*B65B 47/10* (2006.01)

(52) U.S. Cl. ..... 53/559; 53/575

(58) Field of Classification Search ..... 53/175, 53/559, 578; 493/95, 97, 101, 217
See application file for complete search history.

(56) References Cited

U.S. PATENT DOCUMENTS 3,390,618 A * 7/1968 McArdle ..... 493/95
3,715,853 A * 2/1973 Bemiss ..... 493/101
4,200,481 A * 4/1980 Faller ..... 53/175
4,398,380 A * 8/1983 Takamura ..... 53/559
4,611,456 A * 9/1986 Gillio-tos et al. ..... 53/175
6,101,790 A * 8/2000 Mori et al. ..... 53/559
6,334,290 B1 * 1/2002 Reichert et al. ..... 53/559

* cited by examiner

*Primary Examiner*—John Sipos

(74) *Attorney, Agent, or Firm*—Birch, Stewart, Kolasch & Birch, LLP

(57) ABSTRACT

A wrapping machine for paper and plastic packing comprising a machine pedestal with a plastic wrapping fixture, a plastic wrapper supplier, a cutter, a clip board and a heating board are installed on the machine pedestal. The major feature are as follows: more than one packing holes are on the plastic wrapping fixture, the packing holes corresponds to the shape of the bottom of the packing box, a plurality of small holes are on the packing holes to connect to a vacuum pump; the vacuum pump sucks air out, the air goes out through the small holes of the plastic wrapping fixture and the crevices on the packing boxes to have the PET wrapper with back glue attach closely on the surface by the shape of the packing boxes.

4 Claims, 5 Drawing Sheets

WRAPPING MACHINE FOR PAPER AND PLASTIC PACKING

BACKGROUND OF THE INVENTION

I. Field of the Invention

This invention relates generally to a wrapping machine and, more specifically, to a wrapping machine for paper and plastic packing that attaches a banding PET wrapper closely on the surface of the paper or plastic packing; the vacuum pump connecting to the plastic wrapping fixture having small holes sucks air out, the air goes out through the small holes of the plastic wrapping fixture and the crevices on the packing boxes to have the PET wrapper with back glue attach closely on the surface by the shape of the packing boxes.

II. Description of the Prior Art

Heretofore, it is known that the plastic wrapping on the paper and plastic packaging has two common ways: smearing or sprinkling; however the known methods has some drawbacks: the smearing or sprinkling might introduce uneven apertures on the surface of plastic, the food packaging with such wrapping might not have good waterproof and grease-proof effect, such method can not meet the requirement of food or beverages; the plastic wrapper and packaging do not have glue to fasten, the plastic wrapper might fall off easily to influence the quality of contents; the material of the plastic wrapper normally are polypropylene (PP), oriented polypropylene (OPP), oriented polystyrene (OPS), poly ethylene (PE); polyethylene terephthalate (PET) is no seen as wrapper, therefore the known packing are only available for low temperature storage, and not able to be heated in high temperature, especially in oven.

The known packing technology based on above description, the major drawback is the airtight is not good enough that causes water and oil permeation, none of these products can be placed into oven for baking; none of the banding type plastic wrapper with back glue machine for packing are available in the market.

SUMMARY OF THE INVENTION

It is therefore a primary object of the invention to provide a wrapping machine for paper and plastic packing that attaches a banding PET wrapper closely to the surface of a paper and plastic packing to achieve automatic manufacturing effect, the manufacturing cost is lower, the packed products have more application effect.

In order to achieve the objective set forth, a wrapping machine for paper and plastic packing in accordance with the present invention comprises a machine pedestal with a plastic wrapping fixture, a plastic wrapper supplier, a cutter, a clip board and a heating board are installed on the machine pedestal. The major feature are as follows: more than one packing holes are on the plastic wrapping fixture, the packing holes corresponds to the shape of the bottom of the packing box, a plurality of small holes are on the packing holes to connect to a vacuum pump; the paper or plastic packing box is placed into the packing hole, a banding PET wrapper with glue on the back is covered on the packing box by the plastic wrapper supplier, the heating board heats up and makes the PET wrapper soft, the vacuum pump sucks air out to have the PET wrapper with back glue attach closely on the surface of the packing box; then the clip board lifts the packing box attached on the PET wrapper, the plastic wrapping fixture and the lower mold of the cutter are moved to the definite position, the empty packing hole is ready for next packing box; the upper and lower molds of the cutter are in line vertically with the packing box, the upper and lower molds of the cutter cut the PET wrapper along the edges of the pacing box to finish the wrapping. The thickness of the PET wrapper is between 25 $\mu$m to 80 $\mu$m, the back glue is heat condense glue.

The structure effectively attaches a banding PET wrapper closely on the surface of the paper or plastic packing to increase the application effect.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the description given hereinbelow and the accompanying drawings, which are given by way of illustration only, and thus are not limitative of the present invention, and wherein.

DESCRIPTION OF THE PREFERRED EMBODIMENT

Figure 1:
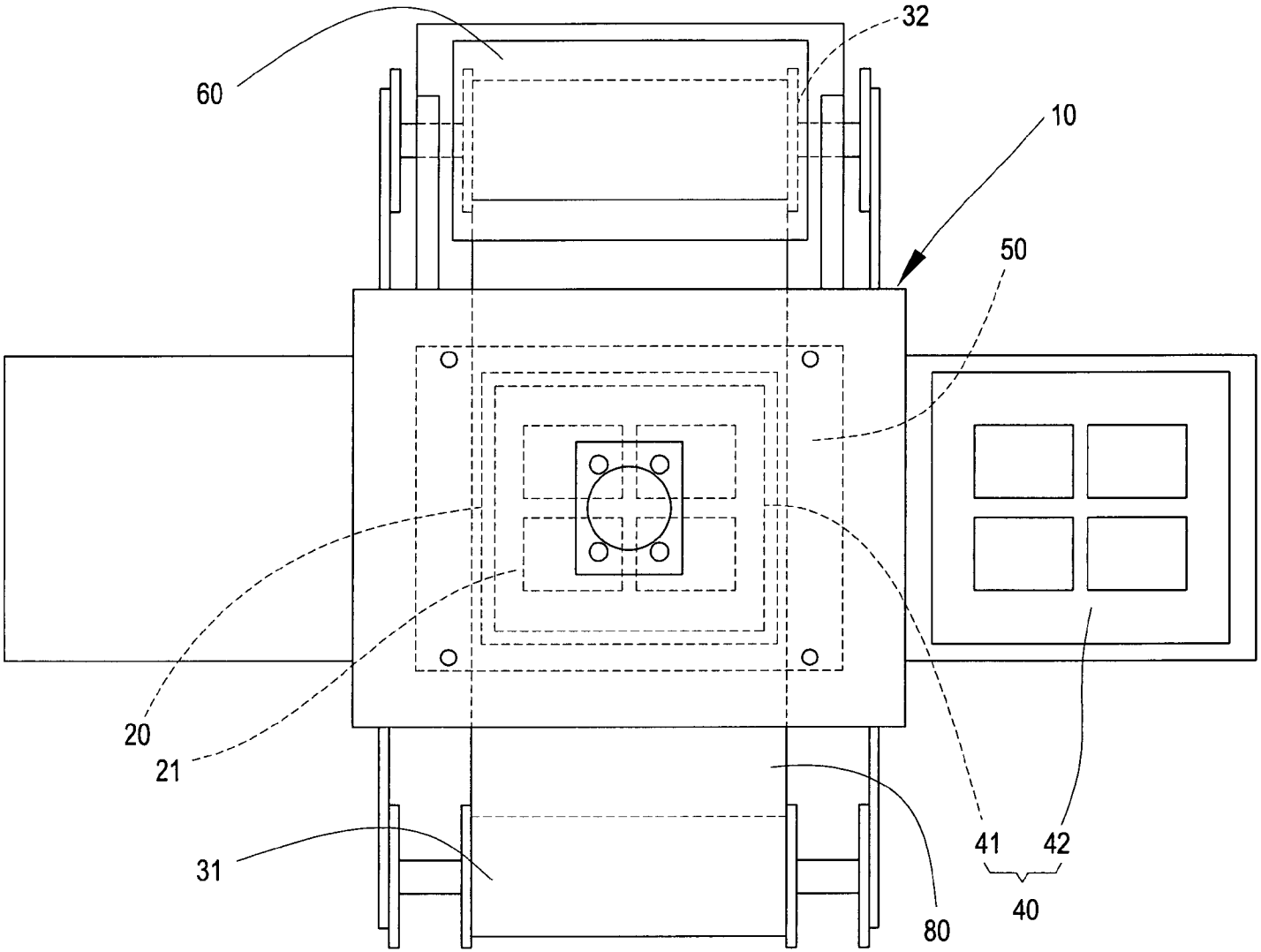
FIG. 1 is a top view of the present invention.
Figure 2:
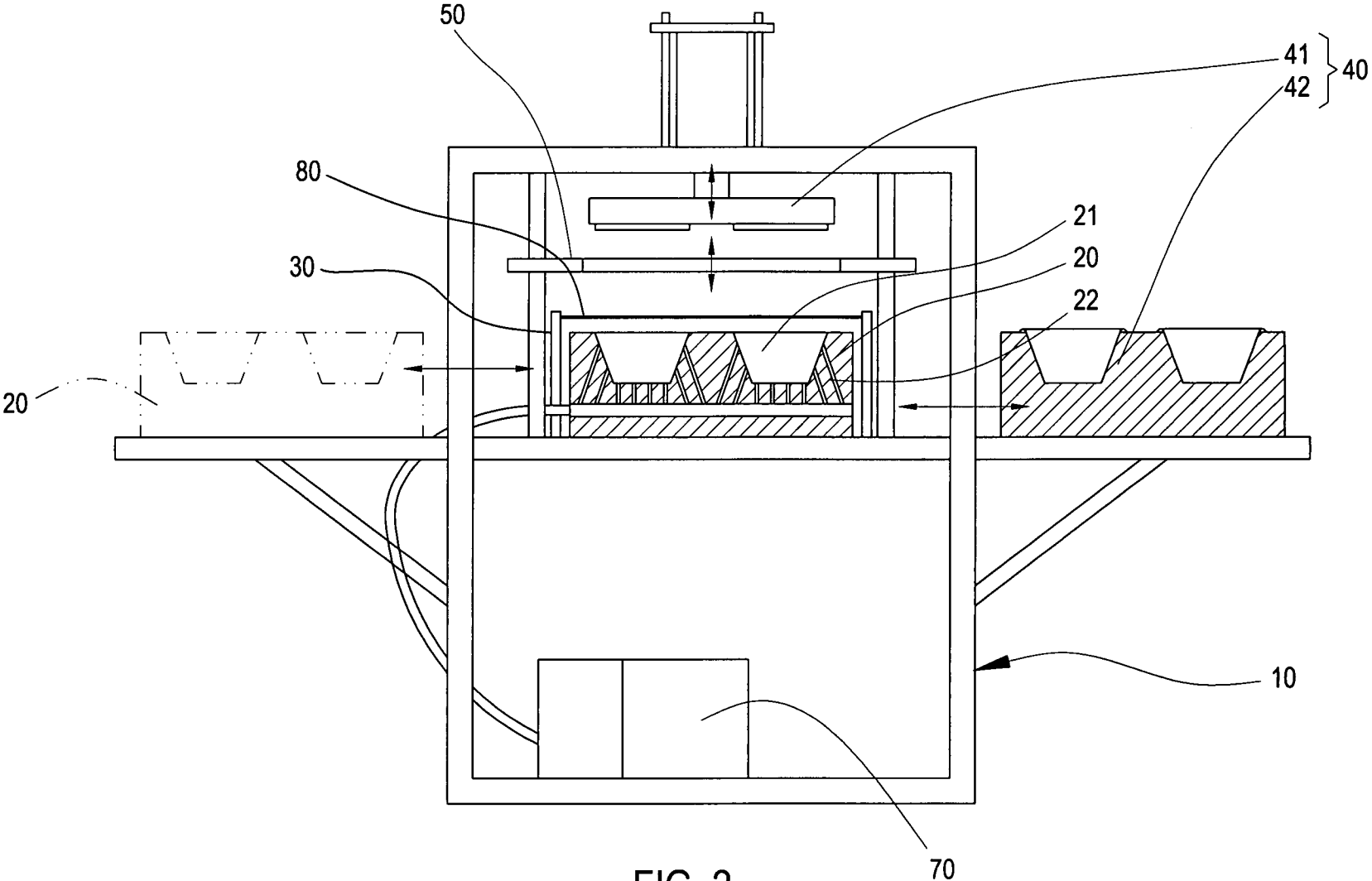
FIG. 2 is a perspective view of the present invention.
Figure 3:
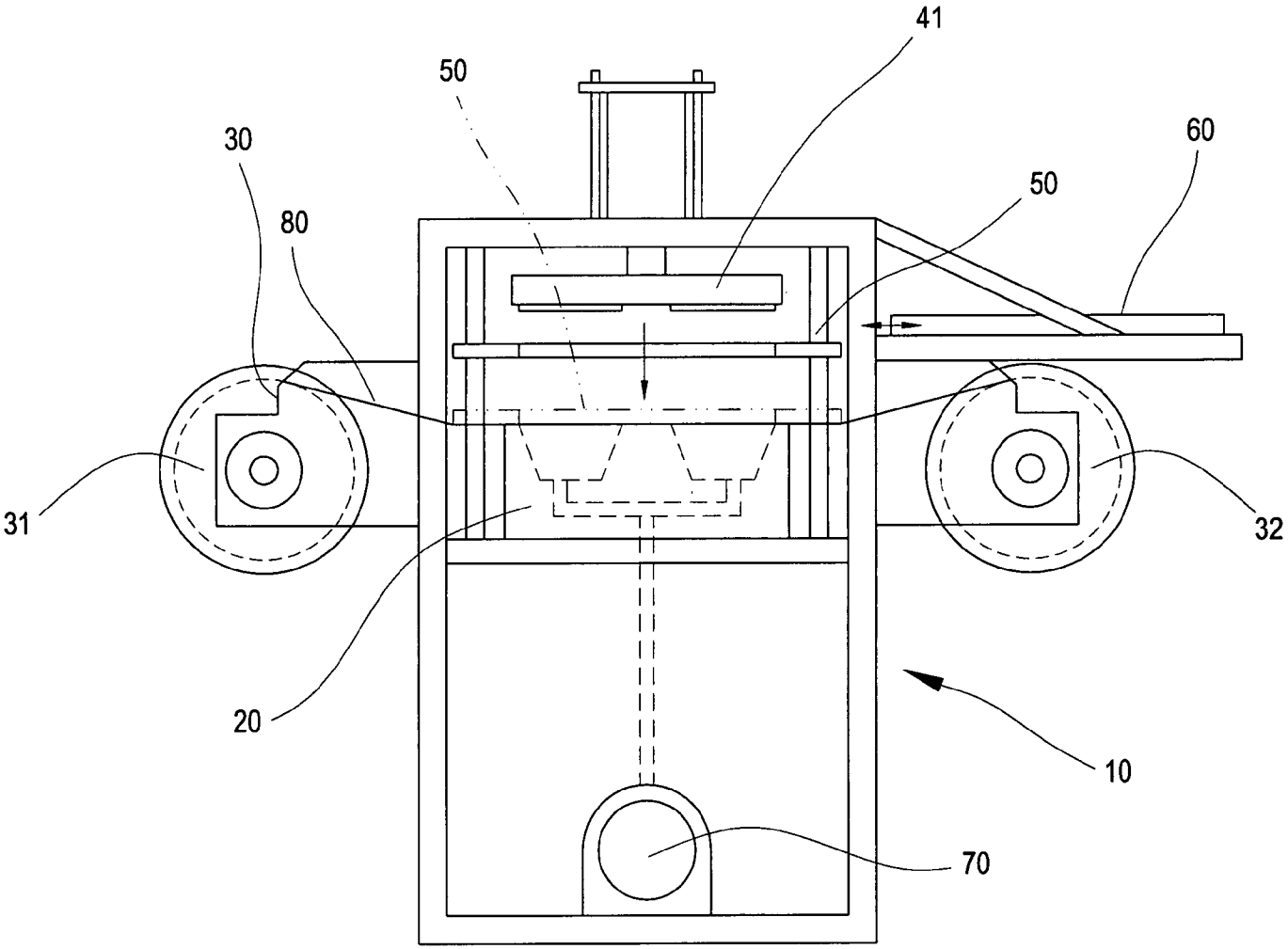
FIG. 3 is a side view of the present invention.

Referring to FIG. 1 to FIG. 3, the present invention comprises a machine pedestal 10 with a plastic wrapping fixture 20, a plastic wrapper supplier 30, a cutter 40, a clip board 50 and a heating board 60 are installed on the machine pedestal 10. The function of each component is described as following:

More than one packing holes 21 are on the plastic wrapping fixture 20, the packing holes 21 corresponds to the shape of the bottom of the packing box 90, a plurality of small holes 22 are on the packing holes 21 to connect to a vacuum pump 70.

Based on the structure described above, as shown in FIG. 1, a wrapper roller 31 and a wrapper retriever 32 of the plastic wrapper supplier 30 are installed on the front and back wall of the machine pedestal 10; the banding PET wrapper 80 is installed on the wrapper roller 31, one end of the banding PET wrapper 80 passes over the plastic wrapping fixture 20 and is fixed on the wrapper retriever 32 to supply the banding PET wrapper 80 continuously, the wrapper retriever 32 retrieves the used wrapper.

As shown in FIG. 2, the cutter 40 further comprises of an upper mold 41 and a lower mold 42, the upper mold 41 is above the machine pedestal 10 and moves up, down vertically corresponding to the plastic wrapping fixture 20; the lower mold 42 is installed on one side of the plastic wrapping fixture 20 and moves horizontally along the plastic wrapping fixture 20 (as shown in FIG. 1) to beneath the upper mold 41 or when the upper mold 41 leaves the position.

The clip board 50 is in square shape and is installed above the machine pedestal 10, between the upper mold 41 of the cutter 40 and the plastic wrapping fixture 20 to move vertically; when the banding PET wrapper 80 passes above the plastic wrapping fixture 20, the clip board 50 presses down the banding PET wrapper 80 to the plastic wrapping fixture 20 and generates airtight condition, as shown in FIG. 3.

The heating board 60 in installed above the wrapper retriever 32 and is on the backside of the machine pedestal 10, the heating board 60 can move forward to the top of the wrapping area of the plastic wrapping fixture 20; before the clip board 50 presses the banding PET wrapper 80 onto the plastic wrapping fixture 20, the heating board 60 heats up and makes the PET wrapper 80 soft.

Figure 4A:
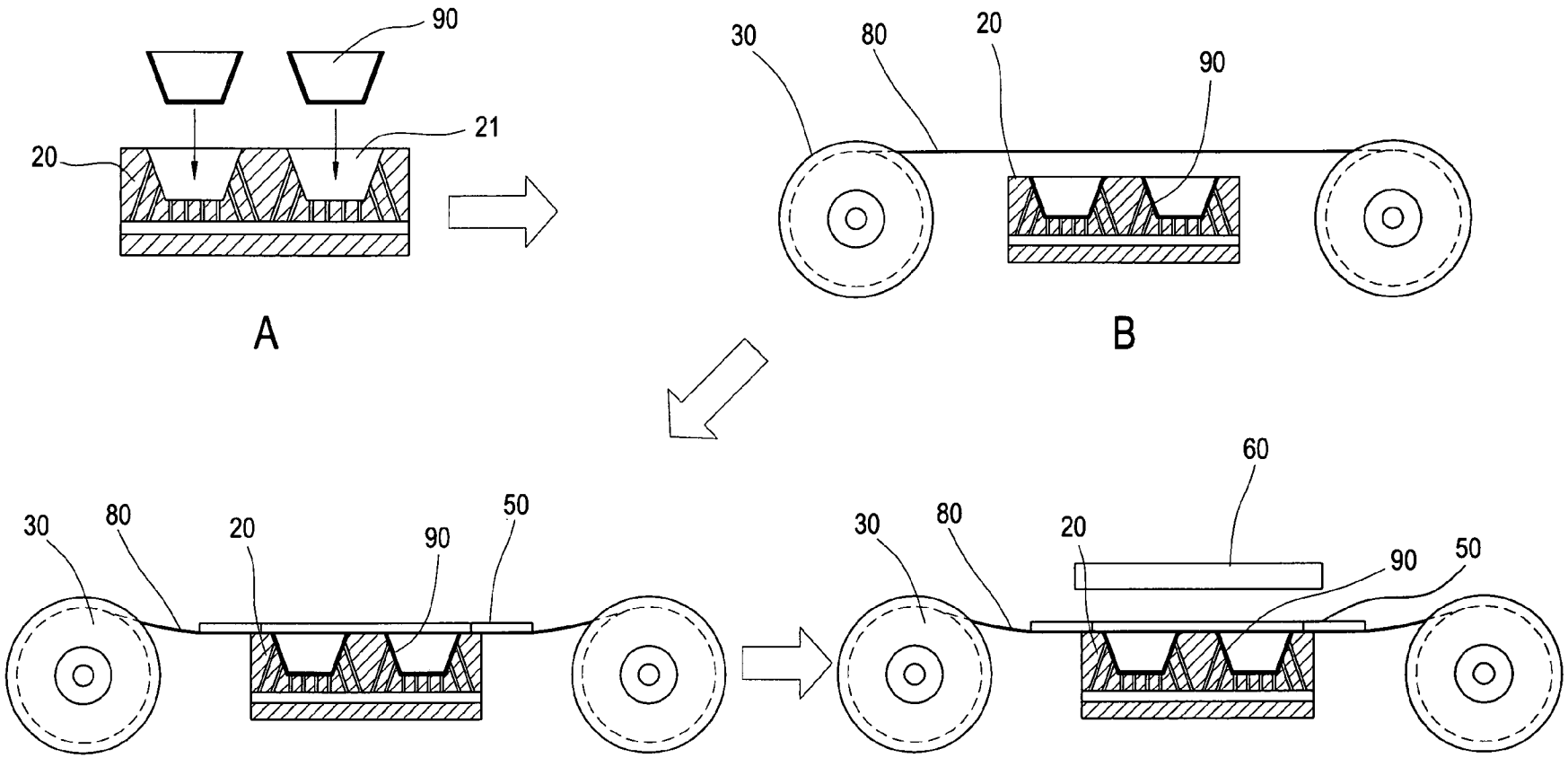
FIGS. 4A and 4B are application views of the present invention.
Figure 4B:
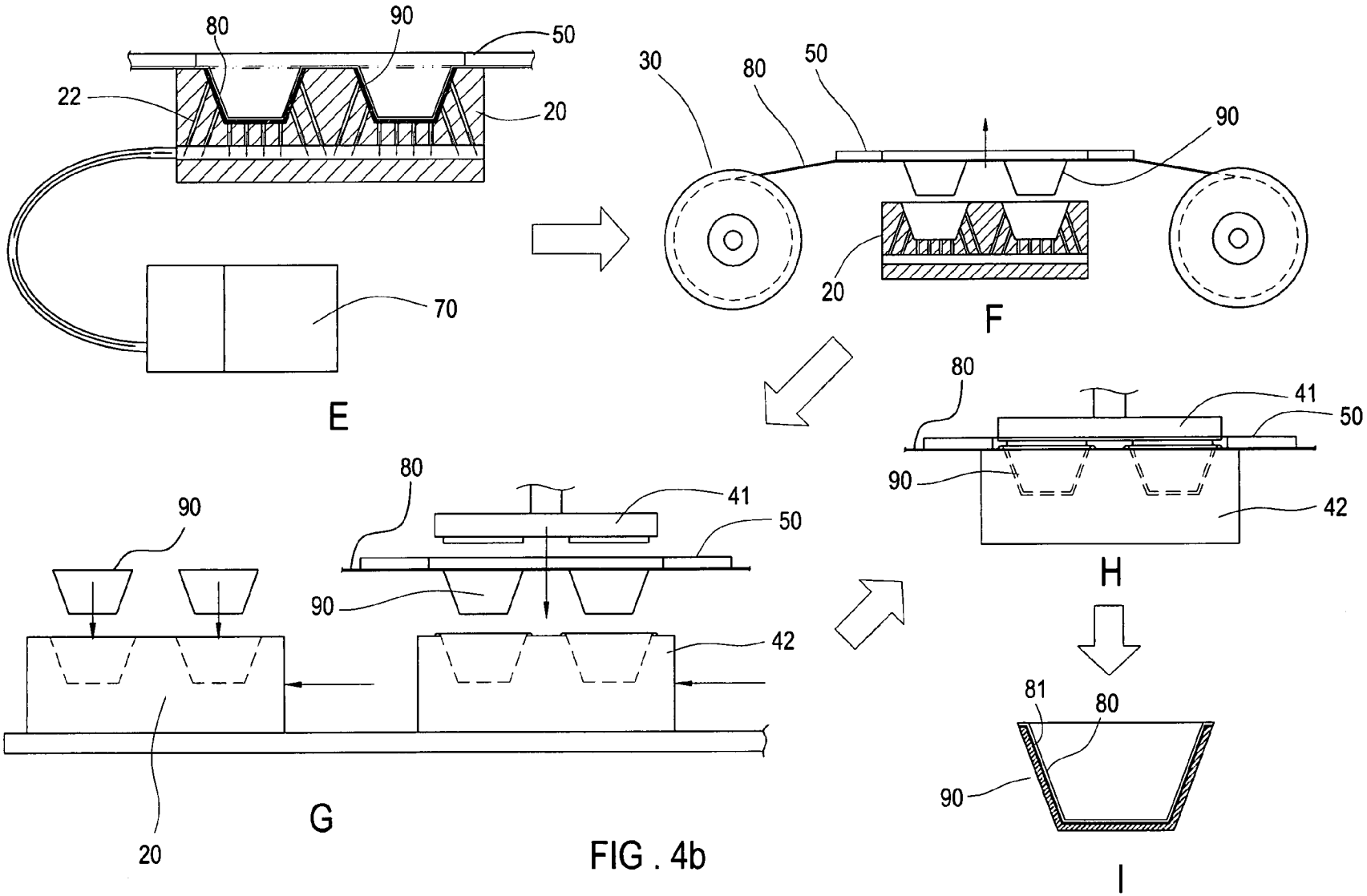

Referring to FIG. 4 and based on above description, the paper or plastic packing box 90 is placed into the packing hole 21 of the plastic wrapping fixture 20, a banding PET wrapper 80 with glue on the back is covered on the packing box 90 by the plastic wrapper supplier 30, the PET wrapper 80 is pressed on the plastic wrapping fixture 20 by the clip board 50, the heating board 60 heats up and makes the PET wrapper 80 soft, the vacuum pump 70 sucks air out, the air goes out through the small holes 22 of the plastic wrapping fixture 20 and the crevices on the packing box 90 to have the PET wrapper 80 with back glue attach closely on the surface by the shape of the packing box 90; then the clip board 50 lifts the packing box 90 attached on the PET wrapper 80, the plastic wrapping fixture 20 and the lower mold 42 of the cutter 40 are moved to the definite position (have the plastic wrapping fixture 20 move out the working area, at the same time have the lower mold 42 under the cutter 40 move to the location corresponding to the upper mold 41, as shown in G chart of FIG. 4, the G chart is vertical to F chart), the empty packing hole 21 is ready for next packing box 90; the upper and lower molds 41, 42 of the cutter 40 are in line vertically with the packing box 90, the upper and lower molds 41, 42 of the cutter 40 cut the PET wrapper 80 along the edges of the pacing box 90 to finish the wrapping.

The thickness of the PET wrapper 80 is between 25 $\mu$m to 80 $\mu$m, the back glue is heat condense glue 81.

The structure described has the banding PET wrapper 80 with back glue attach on the surface of the packing boxes 90 to avoid uneven apertures on the surface of plastic wrapper; the PET wrapper 80 with the heat condense back glue 81 is closely attached to the paper or plastic packing boxes 90, while application, the products in such packing boxes can be applied in high temperature ovens or fast refrigeration.

While a preferred embodiment of the invention has been shown and described in detail, it will be readily understood and appreciated that numerous omissions, changes and additions may be made without departing from the spirit and scope of the invention.

What is claimed is:

1. A wrapping machine for paper and plastic packing comprising:

a machine pedestal;

a vacuum pump for sucking air, said vacuum pump being located in the machine pedestal;

a plastic wrapping fixture located a movable on said machine pedestal a plurality of packing holes being on said plastic wrapping fixture for receiving at least a packing box to be packed, said packing holes corresponding to the shape of the bottom of the packing box, a plurality of small holes being on said packing holes to connect said vacuum pump;

a plastic wrapper supplier located on said machine pedestal, the plastic wrapper supplier being for supplying a banding polyethylene terephthalate (PET) wrapper over the plastic wrapping fixture;

a cutter located on said machine pedestal, said cutter including an upper mold and a lower mold, said upper mold being located above said machine pedestal and moving up and down vertically relative to said plastic wrapping fixture, said lower mold being located on one side of said plastic wrapping fixture and moving horizontally along with the plastic wrapping fixture to be beneath said upper mold and away from said upper mold when said upper mold leaves its lower position;

a clip board located below the cutter for pressing down the banding PET wrapper to said plastic wrapping fixture; and a heating board located on said machine pedestal the heating board being for heating the banding PET wrapper;

wherein said heating board heats up the banding PET wrapper pressed down by the clip board on said plastic wrapping fixture, said vacuum pump sucks the air out through said small holes of said plastic wrapping fixture and the crevices on the packing box to have the heated banding PET wrapper with back glue attached closely on a surface by a shape of the packing box, and the cutter cuts the heated banding PET wrapper along an edge of the packing box.

2. The wrapping machine for paper and plastic packing recited in claim 1, wherein said plastic wrapper supplier includes a wrapper roller and a wrapper retriever, the wrapper roller and a wrapper retriever being located on the front and back wall of said machine pedestal respectively, the banding PET wrapper being installed on the wrapper roller, one end of the banding PET wrapper passing over said plastic wrapping fixture and being fixed on said wrapper retriever to supply the banding PET wrapper, said wrapper retriever retrieving the banding PET wrapper.

3. The wrapping machine for paper and plastic packing recited in claim 1, wherein said clip board is in a square shape and is installed above said machine pedestal and between said upper mold of said cutter and said plastic wrapping fixture, said clip board moving vertically toward said plastic wrapping fixture to press down the banding PET wrapper of said plastic wrapping fixture and generating an airtight condition.

4. The wrapping machine for paper and plastic packing recited in claim 1, wherein said heating board is installed above said wrapper retriever and is on the backside of said machine pedestal, said heating board being movable downward to a top of a wrapping area of said plastic wrapping fixture to heat up the PET wrapper and make the PET wrapper soft.

* * * * *